US009506376B2

(12) United States Patent
Effert et al.

(10) Patent No.: US 9,506,376 B2
(45) Date of Patent: Nov. 29, 2016

(54) FOSSIL-FIRED STEAM GENERATOR

(75) Inventors: Martin Effert, Erlangen (DE); Frank Thomas, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 677 days.

(21) Appl. No.: 13/877,729

(22) PCT Filed: Sep. 30, 2011

(86) PCT No.: PCT/EP2011/067125

§ 371 (c)(1), (2), (4) Date: Apr. 11, 2013

(87) PCT Pub. No.: WO2012/045677

PCT Pub. Date: Apr. 12, 2012

(65) Prior Publication Data

US 2013/0205785 A1 Aug. 15, 2013

(30) Foreign Application Priority Data

Oct. 5, 2010 (DE) ..... 10 2010 041 962

(51) Int. Cl.
*F01K 7/24* (2006.01)
*F01K 7/22* (2006.01)

(52) U.S. Cl.
CPC .. *F01K 7/24* (2013.01); *F01K 7/22* (2013.01)

(58) Field of Classification Search
CPC ..... F01K 23/10; F01K 23/106; F01K 7/24; F01K 7/22; F22B 21/346; Y02E 20/14; Y02E 20/16
USPC ..... 60/39.12, 39.182, 736, 772, 653, 60/677–679; 122/459
See application file for complete search history.

(56) References Cited

U.S. PATENT DOCUMENTS

| | | | | |
|---|---|---|---|---|
| 3,260,246 | A | 7/1966 | Zwetz | |
| 3,385,270 | A | 5/1968 | Rupprecht | |
| 5,365,730 | A * | 11/1994 | Bruckner et al. | 60/39.182 |
| 6,438,939 | B1 | 8/2002 | Kazuharu | |

FOREIGN PATENT DOCUMENTS

| | | | |
|---|---|---|---|
| CN | 101368723 | A | 2/2009 |
| DE | 3607210 | A1 | 8/1986 |
| DE | 4432960 | C1 | 11/1995 |
| DE | 19849740 | A1 | 1/2000 |
| DE | 10227709 | A1 | 2/2003 |
| JP | S5155801 | A | 5/1976 |
| JP | H05118504 | A | 5/1993 |
| JP | H06313506 | A | 11/1994 |
| JP | H07293809 | A | 11/1995 |
| JP | H08121708 | A | 5/1996 |
| JP | H11350921 | A | 12/1999 |
| JP | 2005351576 | A | 12/2005 |

* cited by examiner

*Primary Examiner* — Hoang Nguyen

(57) ABSTRACT

A fossil-fired steam generator for a steam power station includes a number of economizer, evaporator and superheater heating surfaces forming a flow path through which a flow medium flows in a plurality of pressure stages. In a high-pressure stage, an overflow line is connected to the flow path on its inlet side and leads to an injection valve disposed upstream in the flow path from a superheater heating surface in a medium-pressure stage on the flow medium side. The overflow line has two supply lines of which a first supply line branches off on the flow medium side upstream from a high-pressure preheater and a second supply line branches off on the flow medium side downstream from the high-pressure preheater.

8 Claims, 4 Drawing Sheets

FOSSIL-FIRED STEAM GENERATOR

CROSS REFERENCE TO RELATED APPLICATIONS

This application is the US National Stage of International Application No. PCT/EP2011/067125, filed Sep. 30, 2011 and claims the benefit thereof. The International Application claims the benefits of German application No. 10 2010 041 962.1 DE filed Oct. 5, 2010. All of the applications are incorporated by reference herein in their entirety.

FIELD OF INVENTION

The invention relates to a fossil-fired steam generator for a steam power station with a number of economizer, evaporator and superheater heating surfaces forming a flow path through which a flow medium M flows in a plurality of pressure stages, in which, in a high-pressure stage, an overflow line is connected to the flow path on its inlet side and leads to an injection valve disposed in the flow path upstream from a superheater heating surface in a medium-pressure stage on the flow medium side.

BACKGROUND OF INVENTION

A fossil-fired steam generator generates superheated steam with the aid of heat created by the combustion of fossil fuels. Fossil-fired steam generators are mostly used in steam power stations which primarily serve to generate electricity. In such power stations the steam is supplied to a steam turbine.

Like the various pressure stages of a steam turbine, the fossil-fired steam generator also comprises a plurality of pressure stages with different thermal states of the water-steam mixture contained therein in each case. In the first (high) pressure stage the flow medium on its flow path initially flows through economizers which use residual heat to preheat the flow medium, and subsequently flows through various stages of evaporator and superheater heating surfaces. The flow medium is evaporated in the evaporator, then any possible residual moisture is separated off in a separation device and remaining steam contained therein is heated up further in the superheater. The superheated steam then flows into the high-pressure part of the steam turbine, is evaporated there and supplied to the following pressure stage of the steam generator. There it is superheated once more and supplied to the next pressure section of the steam turbine.

As a result of a wide diversity of external influences the heating power transferred to the superheaters can fluctuate greatly. It is therefore frequently necessary to regulate the superheating temperature. Usually this is mostly achieved both in the high-pressure stage and also in the medium-pressure stages for intermediate superheating by an injection of feed water upstream or downstream of individual superheater surfaces for cooling, i.e. an overflow line branches off from the main flow of the flow medium and leads to injection valves disposed accordingly there. The injection in such cases is usually regulated via the temperature deviation from a predetermined nominal temperature value at the outlet of the superheater of the respective pressure stage.

Modern power plants not only demand high levels of efficiency but also a method of operation that is as flexible as possible. As well as short startup times and high load change speeds, these also include the option of compensating for frequency faults in the electricity grid. In order to fulfill these requirements the power plant must be able to provide additional power of for example 5% and more within a few seconds.

Such changes in power of a power station block within seconds are only possible by a coordinated interaction of steam generator and steam turbine. The contribution that the fossil-fired steam generator can make to this process is the use of its boilers, i.e. the steam boiler but also the fuel boiler, as well as rapid changes to the adjustment variables feed water, injection water, fuel and air.

This can be done for example by opening partly-throttled turbine valves of the steam turbine or what is referred to as a step valve, through which the steam pressure upstream of the steam turbine is reduced. Steam from the steam boiler of the upstream fossil-fired steam generator is stored by this process and supplied to the steam turbine. With this measure an increase in power is achieved within a few seconds.

A permanent throttling of the turbine valves to maintain a reserve however always leads to a loss of efficiency, so that to drive the system cost-effectively, the degree of throttling should be kept as low as is absolutely necessary. In addition a number of designs of fossil-fired steam generators, for example once-through steam generators under some circumstances demand a significantly lower boiler volume than for example natural boiler steam generators. The difference in the size of the boiler has an influence in the method described above on the behavior during changes in power of the power station block.

SUMMARY OF INVENTION

The object of the invention is therefore to specify a fossil-fired steam generator of the type described above, in which the efficiency of the steam process is not disproportionately adversely affected. At the same time the short-term power increase is to be made possible regardless of the design of the fossil-fired steam generator without invasive structural modifications to the entire system.

This object is achieved in accordance with invention by the overflow line having two supply lines, of which the first branches before a high-pressure preheater and the second branches off on the flow medium side downstream of the high-pressure preheater.

In this case the invention is based on the idea that additional injection of feed water can make a further contribution to a rapid change in performance. By additional injections in the area of the superheater the steam mass flow can namely be briefly increased. In closed-loop control terms injections are initiated in this case by reducing the nominal temperature value at the outlet of the respective pressure stage. The higher the enthalpy level of the injection water is in such cases, the more injection water mass flow is needed to achieve the new nominal temperature value required. Accordingly a comparatively larger volume of steam is produced from a higher enthalpy level of the injection water.

Such an increase of the enthalpy is possible by the water being tapped off not at the feed pump itself, i.e. upstream of the high-pressure preheaters, but only downstream of a high-pressure preheater. If the nominal temperature value is reduced in such a circuit, this thus results in a comparatively largely volume of steam and thus a greater release of power. In such cases however it should be noted that in the overall load range the injection should be at a sufficient distance from the boiling point line of the steam and thus exhibit a satisfactory undercooling. Precisely during the intermediate superheating it is readily possible in the lower load range for the enthalpy downstream of a high-pressure superheater to be able to be too large in respect of the desired undercooling of the injection water and, in the event of open injection valves, for wet steam to form under some circumstances at the injection point. In the worst case this steam can block the injection valve, so that the injection mass flow cannot be maintained.

This should be counteracted by the enthalpy of the injection water being able to be regulated if necessary. This is able to be achieved by the injection water tapped off downstream of a high-pressure preheater being mixed with a small amount of injection water tapped off upstream of the high-pressure preheater, so that in this way the desired enthalpy of the injection water can be set. For this purpose two supply lines lead respectively from the flow medium side upstream and downstream of a high-pressure preheater to the overflow line for the injection valve of the intermediate superheater.

Advantageously in this case the second supply line branches off on the flow medium side downstream of all high-pressure preheaters. This guarantees the greatest possible enthalpy for the injection water, so that an optimum is achieved in respect of the amount of steam and power release. In a further advantageous embodiment the first supply line branches off on the flow medium side upstream of all high-pressure preheaters. By tapping off the water in the coldest area a reduction of the temperature of the injection medium can namely already be achieved, which guarantees a sufficient distance from the boiling point line. Overall the greatest possible temperature variance is able to be achieved by tapping off upstream and downstream of all high-pressure preheaters.

In an advantageous embodiment a check valve is disposed in one of the supply lines and a throughflow regulation valve is disposed in the other supply line. The medium is then mixed in an especially simple manner, on the one hand by determining the injection amount which is set by the injection regulation valve and is partly made available via the supply line with the check valve, wherein the check valve prevents a flowback from the high-pressure path into the low-pressure path. On the other hand the admixture of the medium of the respective other temperature is regulated via the throughflow regulation valve of the other supply line.

In an especially advantageous embodiment a check valve is disposed here in the first supply line and a throughflow regulation valve is disposed in the second supply line. This means that the check valve is located in the supply line with the medium of the lower temperature level. Advantageously the first supply line also branches off from a feed pump. Since under these circumstances the flow medium only has a comparatively higher pressure upstream from the throughflow regulation valve, it is possible in this way for the entire water path of the injection device to be at a comparatively low pressure level. In addition such an arrangement simplifies the regulation and it is further possible to use the feed pump normally used nowadays with the corresponding branch for the intermediate superheating injection since the cool medium can also be tapped off at the same point in the present case.

In a further advantageous embodiment a throughflow measurement device is disposed in the flow path on the flow medium side downstream from the branching-off point of the second supply line. The amount tapped off does not then namely, under these circumstances for the injection water regulation, have to be taken into account via an additional measurement or a separate balancing.

In an advantageous embodiment a steam power station has a fossil-fired steam generator of this type.

The advantages obtained with the invention consist in particular of always enabling a sufficient undercooling of the injection water to be guaranteed by mixing injection water for the intermediate superheating from supply lines upstream and downstream of high-pressure preheaters, on the other hand in respect of provision of an immediate reserve for absolutely secure injection operation without steam formation, of enabling a maximum of additional power release to be realized by a correspondingly increased injection amount. As an alternative, with the same release of power by comparison with previous concepts, the load on all components involved, such as injection point, heating surfaces and turbine, can be reduced since for the same amount of power released a smaller drop in temperature of the steam is to be expected.

In addition the circuit and the associated increase in released power by using the injection system is independent of other measures, so that throttled turbine valves can also additionally be opened for example in order to further strengthen the power increase of the steam turbine. The effectiveness of the method is largely unaffected by these parallel measures.

It should be stressed here that with a fixed predetermined requirement for additional power the degree of throttling of the turbine valves can be reduced, should the use of the injection system be applied for increasing the power. The desired power release can under these circumstances then also be achieved with lower, in the best case even entirely without additional throttling. Thus the plant can be operated in normal load operation in which it must be available for an immediate reserve, with a comparatively high efficiency, which also reduces operating costs.

BRIEF DESCRIPTION OF THE DRAWINGS

An exemplary embodiment of the invention will be explained in greater detail with reference to a drawing, in which.

DETAILED DESCRIPTION OF INVENTION

Figure 1:
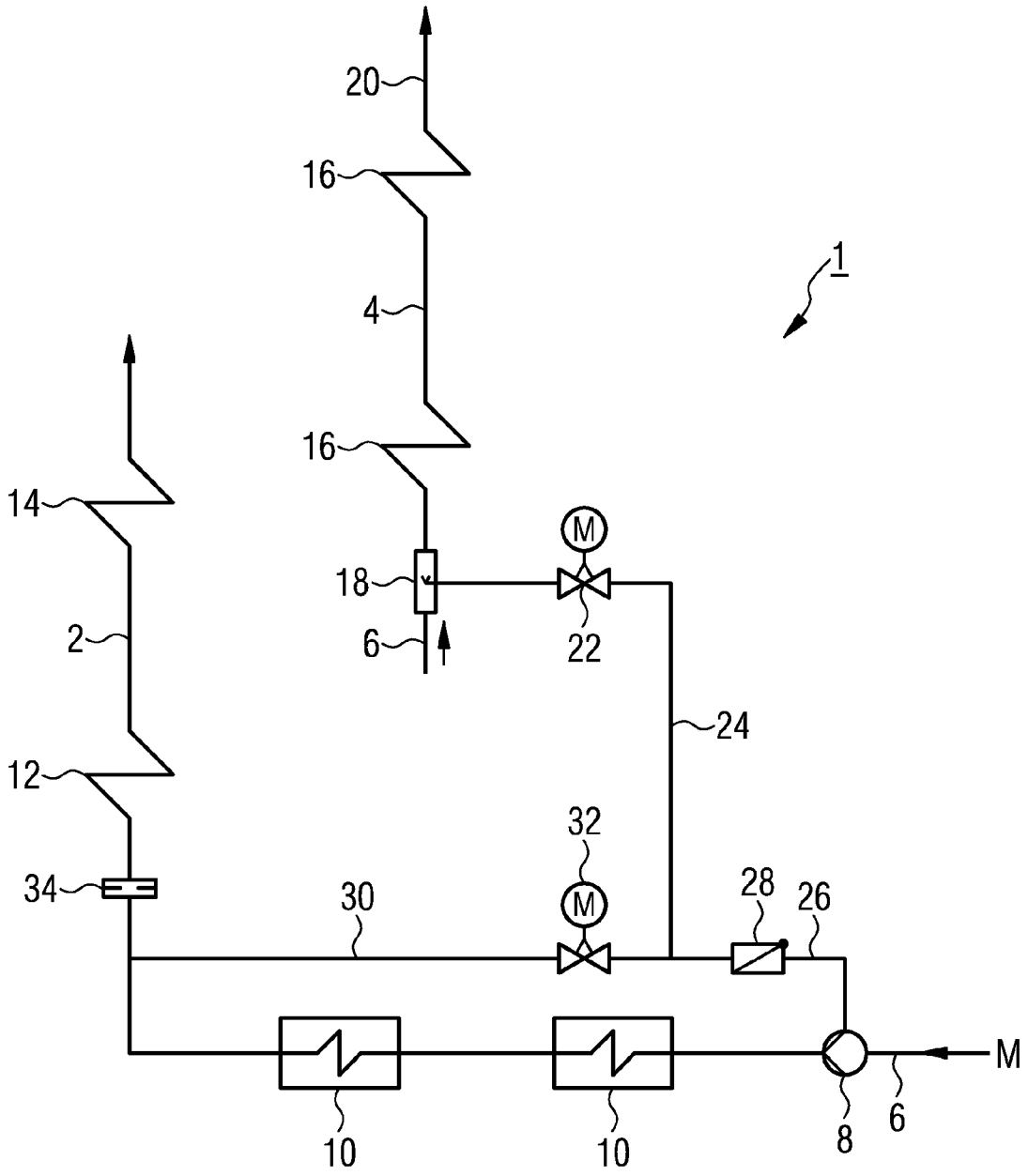
FIG. 1 shows a flow-medium-side schematic of the high-pressure and medium-pressure part of a fossil-fired steam generator with optimized injection water supply.

Identical parts are provided with the same reference characters in all figures.

FIG. 1 shows the high-pressure part 2 and the medium-pressure part 4 of the fossil-fired steam generator 1. FIG. 1 represents a schematic of a part of the flow path 6 of the flow medium M. The flow medium M is initially injected through a feed pump 8 into the high-pressure part 2. There it is initially heated by high-pressure preheaters 10 to an increased temperature, which for example can be operated with tapped-off steam. There then follow economizer heating surfaces 12, in which usually flue gas waste heat is used for further heating of the flow medium and evaporator heating surfaces 14, in which the flow medium is evaporated with the aid of heat obtained from fossil fuel. The spatial arrangement of the individual heating surfaces 12, 14 in the hot gas duct is not shown and can vary. The heating surfaces 12, 14 shown can respectively represent a plurality of serially-connected heating surfaces, which however, for reasons of clarity, are not shown differentiated.

After exit from the evaporator heating surfaces 14 any residual moisture which may be present is separated off in a water separation device not shown in any greater detail and the remaining steam is supplied to superheater surfaces not shown in any greater detail. Subsequently the superheated steam is evaporated in the high-pressure part of the steam turbine. Subsequently the flow medium M flows into the medium pressure part 4 of the steam generator where it is superheated once again in a number of intermediate superheating heating surfaces 16 and subsequently supplied to the medium pressure part of the steam turbine.

Disposed upstream of the superheater heating surfaces on the flow medium side is an injection valve 18. Here cooler and unevaporated flow medium M can be injected for regulating the outlet temperature at the outlet 20 of the medium pressure part 4 of the fossil-fired steam generator 1. The amount of flow medium M introduced into the injection valve 18 is regulated via an injection control valve 22. The flow medium M in this case is supplied via an overflow line 24 branching off upstream in the flow path 2.

To be able to use the injection system not only for regulation of the outlet temperature, but also to provide an immediate power reserve, the injection system is designed for an on-demand increase of the enthalpy of the injection water. For this purpose the overflow line 24 has a first supply line 26, which branches off directly in the feed pump 8 and supplies flow medium M at a comparatively low temperature to the overflow line 24. This guarantees that there is always sufficient undercooling of the injection medium. The first supply line 26 also includes a check valve flap 28, which prevents a flowback of medium from the injection system.

Furthermore the overflow line has a second supply line 30, the throughflow of which is regulated by a throughflow regulation valve 32. The second supply line branches off downstream from all high-pressure preheaters 10 upstream of the economizer heating surfaces 12, so that here flow medium M is introduced at a comparatively higher temperature into the overflow line 24. This achieves a significant increase in the amount of steam with a comparatively greater injection and increases the power of the downstream steam turbine. The throughflow measurement device 34 here is disposed in the flow path 6 downstream of the two branching-off points of the supply lines 26, 30 so that the amount of flow medium M tapped off does not need be taken into account here for the injection water regulation.

Figure 2:
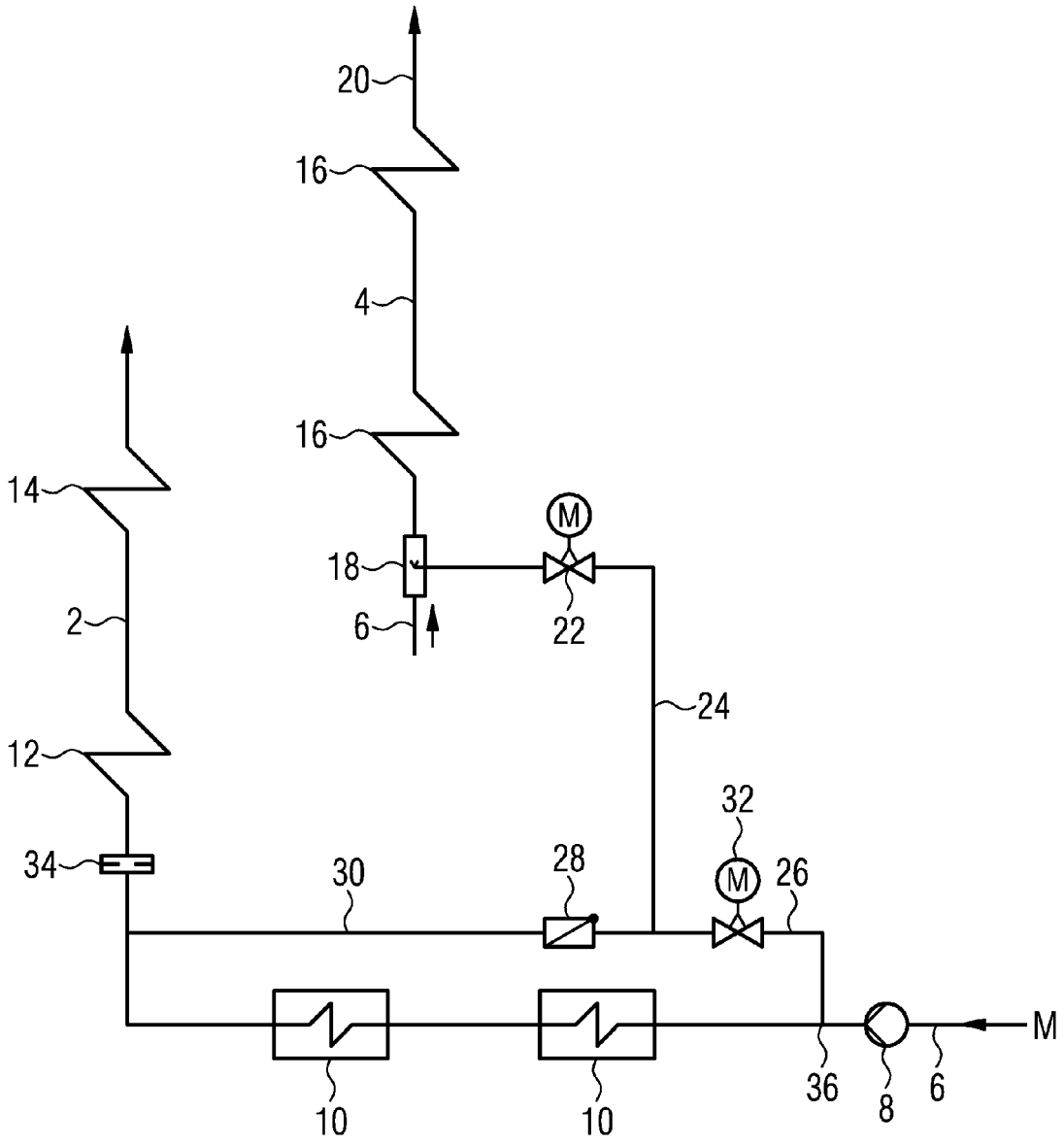
FIG. 2 shows a flow-medium-side schematic of the high-pressure and medium-pressure part of a fossil-fired steam generator with injection water supply in an alternate embodiment.

FIG. 2 shows an alternate embodiment, which essentially corresponds to FIG. 1, however the locations of throughflow regulation valve 32 and check valve flap 28 are reversed here. The first supply line 26 thus has a regulation valve 32 and the second supply line 30 a check valve flap 28. This embodiment is likewise possible, however the overall injection path is to be designed for higher pressures. Over and above this an additional branch 36 is to be provided for the first supply line 26 since, as a result of the higher pressure level, flow medium M cannot be removed at any given point of the feed pump 8.

Figure 3:
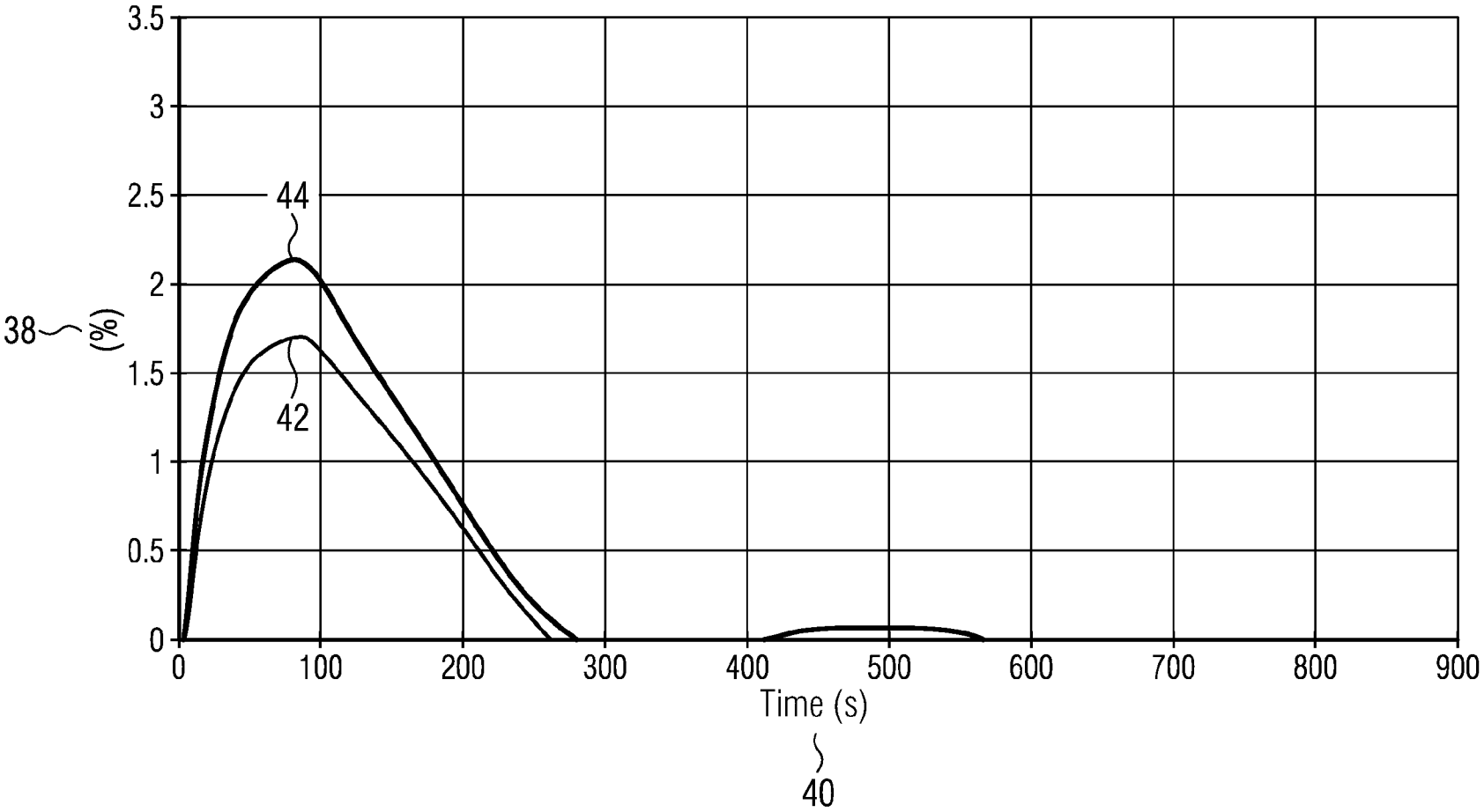
FIG. 3 shows a diagram with simulation results for improving the immediate reserve of a fossil-fired steam generator by increasing the injection water enthalpy of the intermediate superheating in the upper load range.

FIG. 3 shows a diagram with simulation results when the described circuit is utilized. The graph plots the percentage of additional power in relation to full load 38 against the time 40 in seconds after a sudden reduction of the nominal temperature value for the temperature at the outlet 20 of the medium pressure part 4 by 20° C. at 95% load. In this case the curve 42 shows the results without heated injection fluid, i.e. in accordance with the usual system, the curve 44 shows the results with the connected injection system as described above. It can be seen in FIG. 2 that the maximum of curve 44 is higher than that of curve 42. The additional power released is thus higher.

Figure 4:
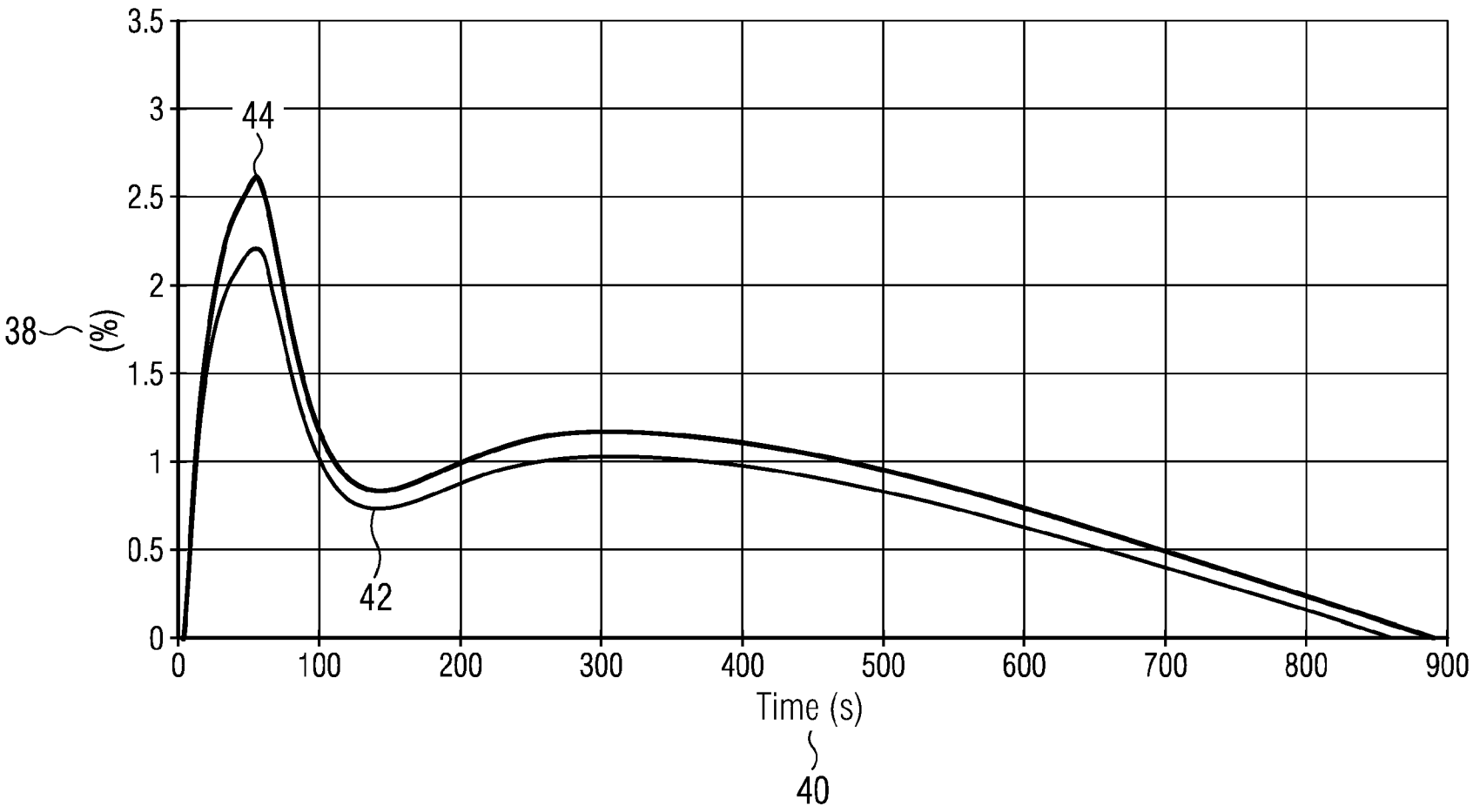
FIG. 4 shows a diagram with simulation results for improving the immediate reserve of a fossil-fired steam generator by increasing the injection water enthalpy of the intermediate superheating in a lower load range.

FIG. 4 is only slightly modified compared to FIG. 3 and shows the simulated curves 42, 44 for 40% load, all other parameters match those of FIG. 3, as does the meaning of curves 42, 44. Here the two curves 42, 44 have a flat shape and additionally a comparatively higher power increase approximately 60 seconds after the nominal value is changed, which falls quickly again thereafter in order to transition into the maximum of the flat curve. Overall the curve 44 is higher at all times than the curve 42. This means that a higher power release is also possible here, wherein despite the load only being 40%, a sufficient undercooling of the injected medium is guaranteed.

A steam power station equipped with such a fossil-fired steam generator 1 is able, via an immediate power release of the steam turbine, quickly to provide a power increase which serves to support the frequency of the electricity grid. The fact that this power reserve is achieved by a double use of the injection valves as well as the usual temperature regulation also enables permanent throttling of the steam turbine valves for provision of a reserve to be reduced or even dispensed with entirely, through which an especially high efficiency is achieved during normal operation.

The invention claimed is:

1. A fossil-fired steam generator for a steam power station, comprising:

a plurality of pressure stages forming a flow path through which a flow medium flows, the flow medium comprising water/steam, wherein the plurality of pressure stages include a high pressure stage and a medium pressure stage, wherein the high pressure stage comprises in a fluid flow direction through which the flow medium flows, a preheater, an economizer, and an evaporator, wherein the medium pressure stage comprises in a fluid flow direction through which the flow medium flows an injection valve and a superheater heating surface, wherein in the high-pressure stage, an overflow line is connected to the flow path at an inlet to the high pressure stage on its inlet side and leads to the injection valve disposed upstream in the flow path from the superheater heating surface in the medium-pressure stage on a flow medium side, wherein the overflow line has two supply lines of which supply the flow medium to the overflow line, wherein a first supply line branches off on the flow medium side upstream from the high-pressure preheater and a second supply line branches off on the flow medium side downstream from the high-pressure preheater, and wherein the flow medium is injected into the inlet of the high pressure stage by a feed pump.

2. The fossil-fired steam generator as claimed in claim 1, wherein the second supply line branches off on the flow medium side downstream from all high-pressure preheaters.

3. The fossil-fired steam generator as claimed in claim 1, wherein the first supply line branches off on the flow medium side upstream from all high-pressure preheaters.

4. The fossil-fired steam generator as claimed in claim 1, wherein a check valve flap is disposed in one of the supply lines and a throughflow regulation valve is disposed in the other supply line.

5. The fossil-fired steam generator as claimed in claim 1, wherein a check valve flap is disposed in the first supply line and a throughflow regulation valve is disposed in the second supply line.

6. The fossil-fired steam generator as claimed in claim 5, wherein the first supply line branches off from a feed pump.

7. The fossil-fired steam generator as claimed in claim 1, wherein a throughflow measurement device is disposed in the flow path on the flow medium side downstream from the branch of the second supply line.

8. A steam power station, comprising:

a fossil-fired steam generator as claimed in claim 1.

* * * * *